US006505800B1

(12) United States Patent
Abdullah

(10) Patent No.: US 6,505,800 B1
(45) Date of Patent: Jan. 14, 2003

(54) SHELVING ASSEMBLY

(76) Inventor: Muhammad A. Abdullah, 1604 Misty Fawn La., Fresno, TX (US) 77545

( * ) Notice: Subject to any disclaimer, the term of this patent is extended or adjusted under 35 U.S.C. 154(b) by 0 days.

(21) Appl. No.: 09/785,158

(22) Filed: Feb. 16, 2001

(51) Int. Cl.[7] ..... A47G 29/02; A47B 11/00

(52) U.S. Cl. ..... 248/250; 248/241; 248/243; 108/743

(58) Field of Search ..... 248/250, 235, 248/241, 242, 247, 298.1, 220.31, 220.41, 220.43, 225.21; 211/134, 187, 153; 108/105, 143

(56) References Cited

U.S. PATENT DOCUMENTS

| | | | | | |
|---|---|---|---|---|---|
| 1,702,937 | A | * | 2/1929 | Friedemann | 248/243 |
| 2,833,420 | A | | 5/1958 | Streater | |
| 2,933,196 | A | * | 4/1960 | Childs | 211/183 |
| 3,565,381 | A | | 2/1971 | Oliver | |
| 4,018,167 | A | | 4/1977 | Spangler | |
| 4,299,362 | A | * | 11/1981 | Buluschek et al. | 248/49 |
| 4,374,498 | A | | 2/1983 | Yellin | |
| 4,589,349 | A | * | 5/1986 | Gebhardt et al. | 108/102 |
| 4,620,489 | A | * | 11/1986 | Albano | 108/105 |
| 4,646,658 | A | * | 3/1987 | Lee | 108/143 |
| 4,669,692 | A | | 6/1987 | Mastrodicasa | |
| 4,674,723 | A | * | 6/1987 | Bayuk | 248/246 |
| D295,950 | S | | 5/1988 | Johnston | |
| 5,484,068 | A | * | 1/1996 | Huang | 211/193 |
| 5,531,159 | A | * | 7/1996 | Stubblefield | 108/102 |
| 5,895,020 | A | * | 4/1999 | Danzyger et al. | |

* cited by examiner

*Primary Examiner*—Anita King

(57) ABSTRACT

A shelving assembly for supporting shelving of varying sizes. The shelving assembly includes an extendable shelf support comprising a stationary bracket and a slidable member slidably mounted on the stationary bracket. A securing means is provided for securing the slidable member in a selected position with respect to the stationary bracket.

20 Claims, 6 Drawing Sheets

SHELVING ASSEMBLY

BACKGROUND OF THE INVENTION

1. Field of the Invention

The present invention relates to shelves and more particularly pertains to a new shelving assembly for supporting shelving of varying sizes.

2. Description of the Prior Art

The use of shelves is known in the prior art. More specifically, shelves heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,833,420; U.S. Pat. No. 4,018,167; U.S. Pat. No. 4,374,498; U.S. Pat. No. 4,669,692; U.S. Pat. No. 3,565,381; and U.S. Pat. No. Des. 295,950.

While these devices fulfill their respective, particular objectives and requirements, the aforementioned patents do not disclose a new shelving assembly. The inventive device includes an extendable shelf support comprising a stationary bracket and a slidable member being slidably mounted on the stationary bracket. A securing means is provided for securing the slidable member in a selected position with respect to the stationary bracket.

In these respects, the shelving assembly according to the present invention substantially departs from the conventional concepts and designs of the prior art, and in so doing provides an apparatus primarily developed for the purpose of supporting shelving of varying sizes.

SUMMARY OF THE INVENTION

In view of the foregoing disadvantages inherent in the known types of shelves now present in the prior art, the present invention provides a new shelving assembly construction wherein the same can be utilized for supporting shelving of varying sizes.

The general purpose of the present invention, which will be described subsequently in greater detail, is to provide a new shelving assembly apparatus and method which has many of the advantages of the shelves mentioned heretofore and many novel features that result in a new shelving assembly which is not anticipated, rendered obvious, suggested, or even implied by any of the prior art shelves, either alone or in any combination thereof.

To attain this, the present invention generally comprises an extendable shelf support comprising a stationary bracket and a slidable member being slidably mounted on the stationary bracket. A securing means is provided for securing the slidable member in a selected position with respect to the stationary bracket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shelving assembly apparatus and method which has many of the advantages of the shelves mentioned heretofore and many novel features that result in a new shelving assembly which is not anticipated, rendered obvious, suggested, or even implied by any of the prior art shelves, either alone or in any combination thereof.

It is another object of the present invention to provide a new shelving assembly which may be easily and efficiently manufactured and marketed.

It is a further object of the present invention to provide a new shelving assembly which is of a durable and reliable construction.

An even further object of the present invention is to provide a new shelving assembly which is susceptible of a low cost of manufacture with regard to both materials and labor, and which accordingly is then susceptible of low prices of sale to the consuming public, thereby making such shelving assembly economically available to the buying public.

Still yet another object of the present invention is to provide a new shelving assembly which provides in the apparatuses and methods of the prior art some of the advantages thereof, while simultaneously overcoming some of the disadvantages normally associated therewith.

Still another object of the present invention is to provide a new shelving assembly for supporting shelving of varying sizes.

Yet another object of the present invention is to provide a new shelving assembly that includes an extendable shelf support comprising a stationary bracket and a slidable member slidably mounted on the stationary bracket. A securing means is provided for securing the slidable member in a selected position with respect to the stationary bracket.

Still yet another object of the present invention is to provide a new shelving assembly that, unlike the prior art where the shelf could be easily knocked off of the support bracket, provides a fastening means for fastening the shelf to the support bracket.

Even still another object of the present invention is to provide a new shelving assembly that, unlike the prior art wherein the shelf had to be removed to extend the support bracket, allows the shelf to be moved while extending the support bracket.

These together with other objects of the invention, along with the various features of novelty which characterize the invention, are pointed out with particularity in the claims annexed to and forming a part of this disclosure: For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
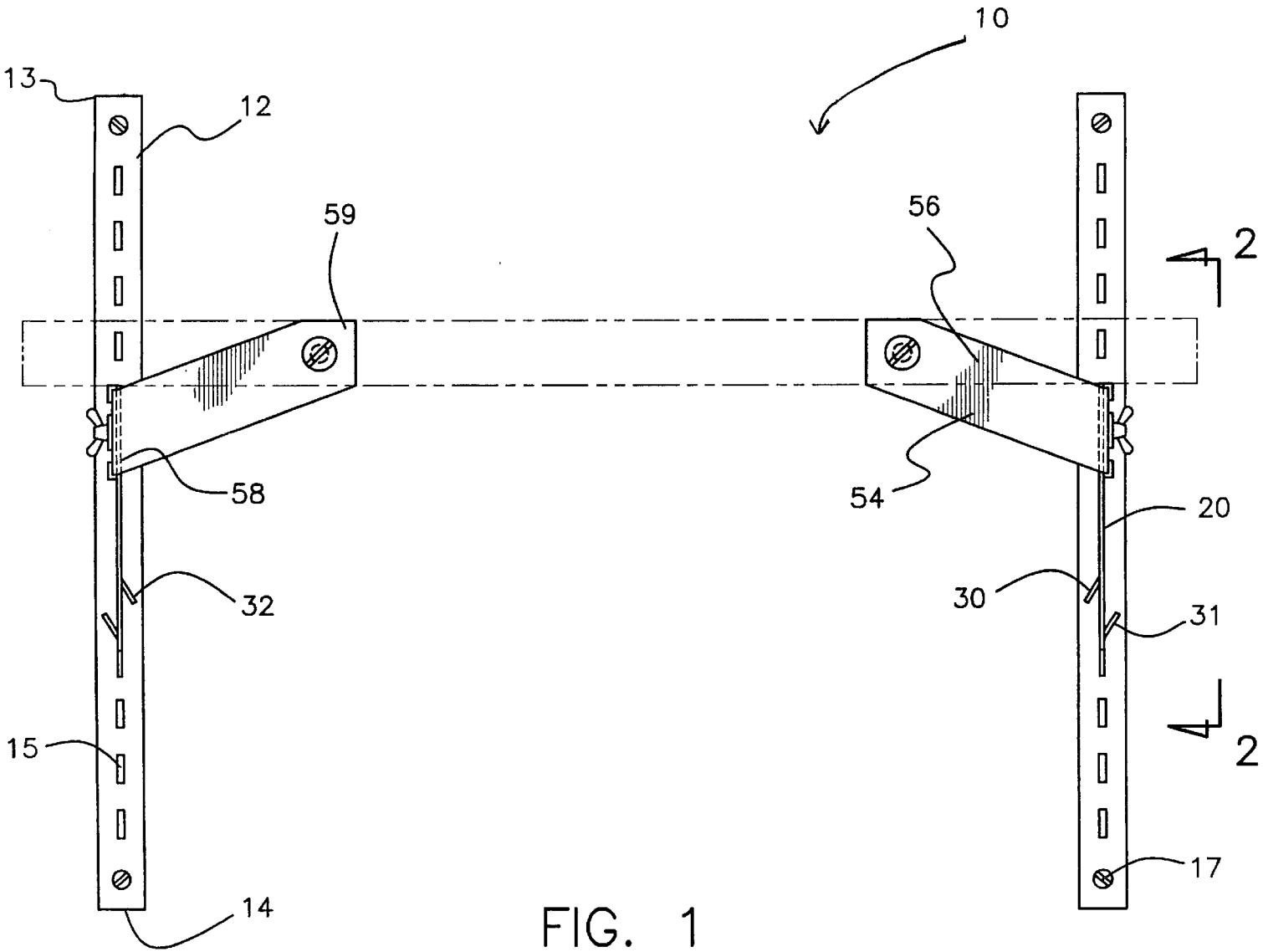
FIG. 1 is a schematic frontal view of a new shelving assembly being attached to a pair of mounting members and a shelf according to the present invention.
Figure 2:
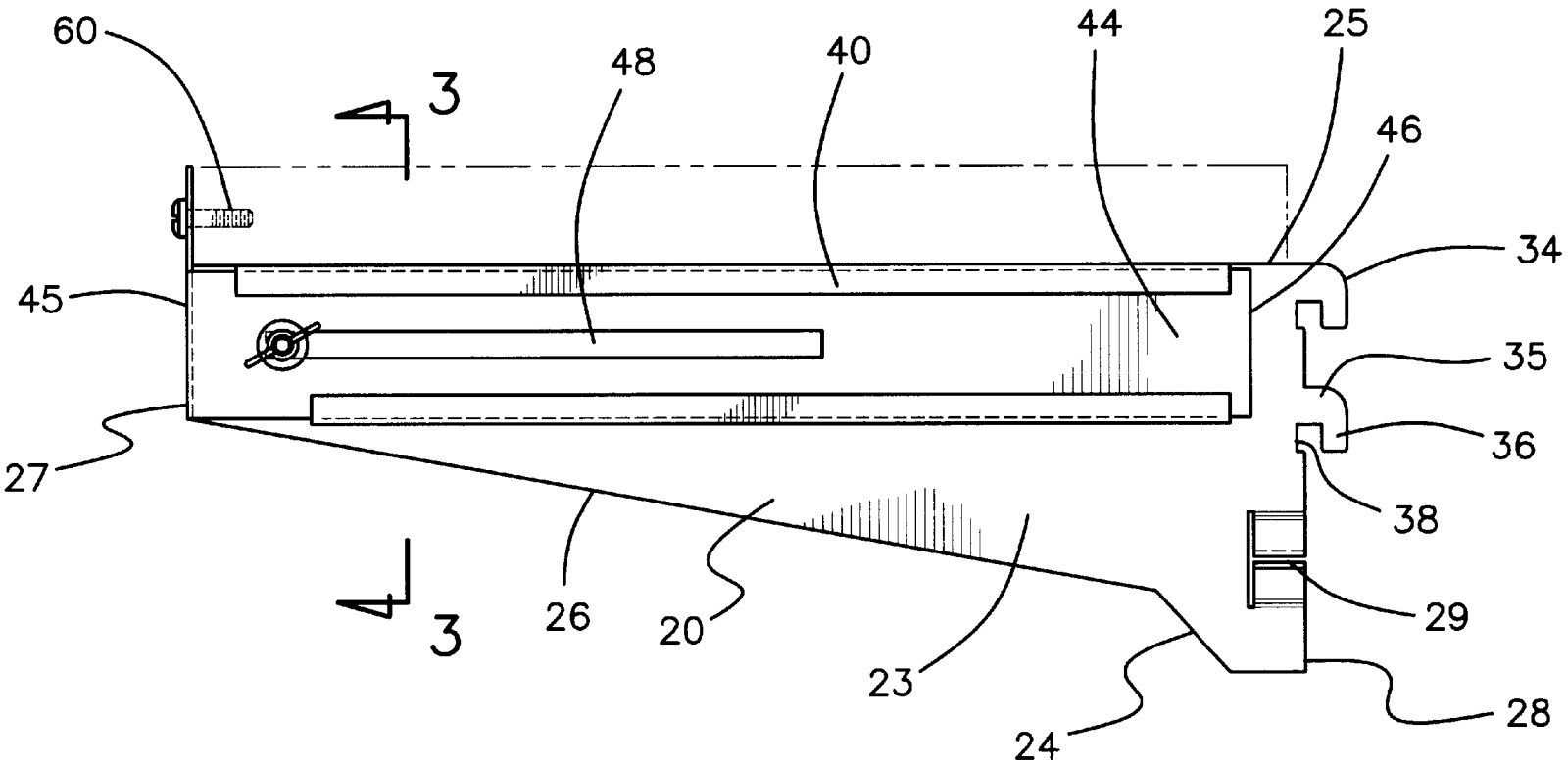
FIG. 2 is a schematic side view of the shelf support comprising a stationary bracket and a slidable member attached to the side of the stationary bracket.
Figure 3:
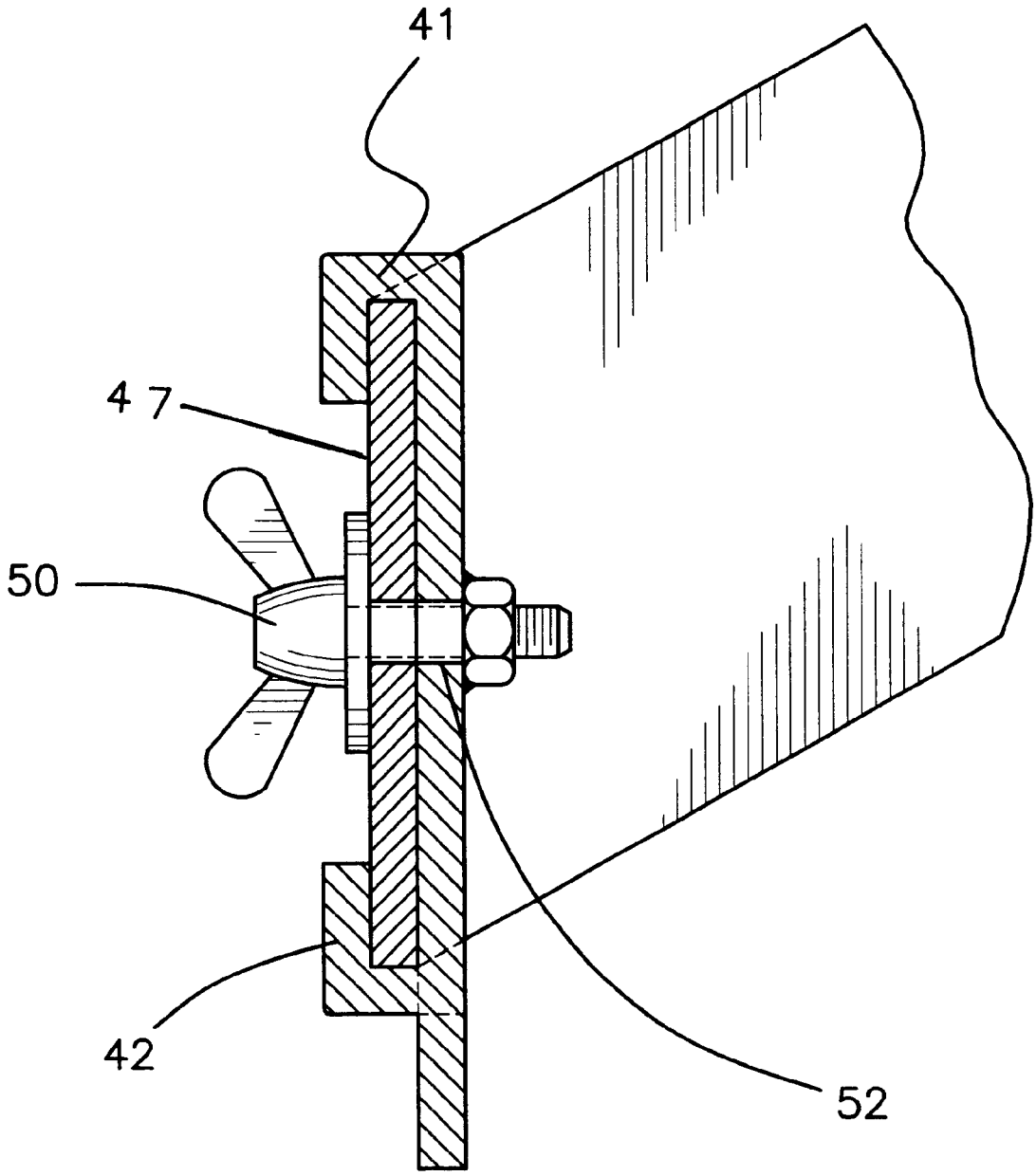
FIG. 3 is a schematic cross-sectional view of the present invention taken along line 3—3 of FIG. 2 showing a slidable member positioned between a pair of rails and secured together by a securing means.
Figure 4:
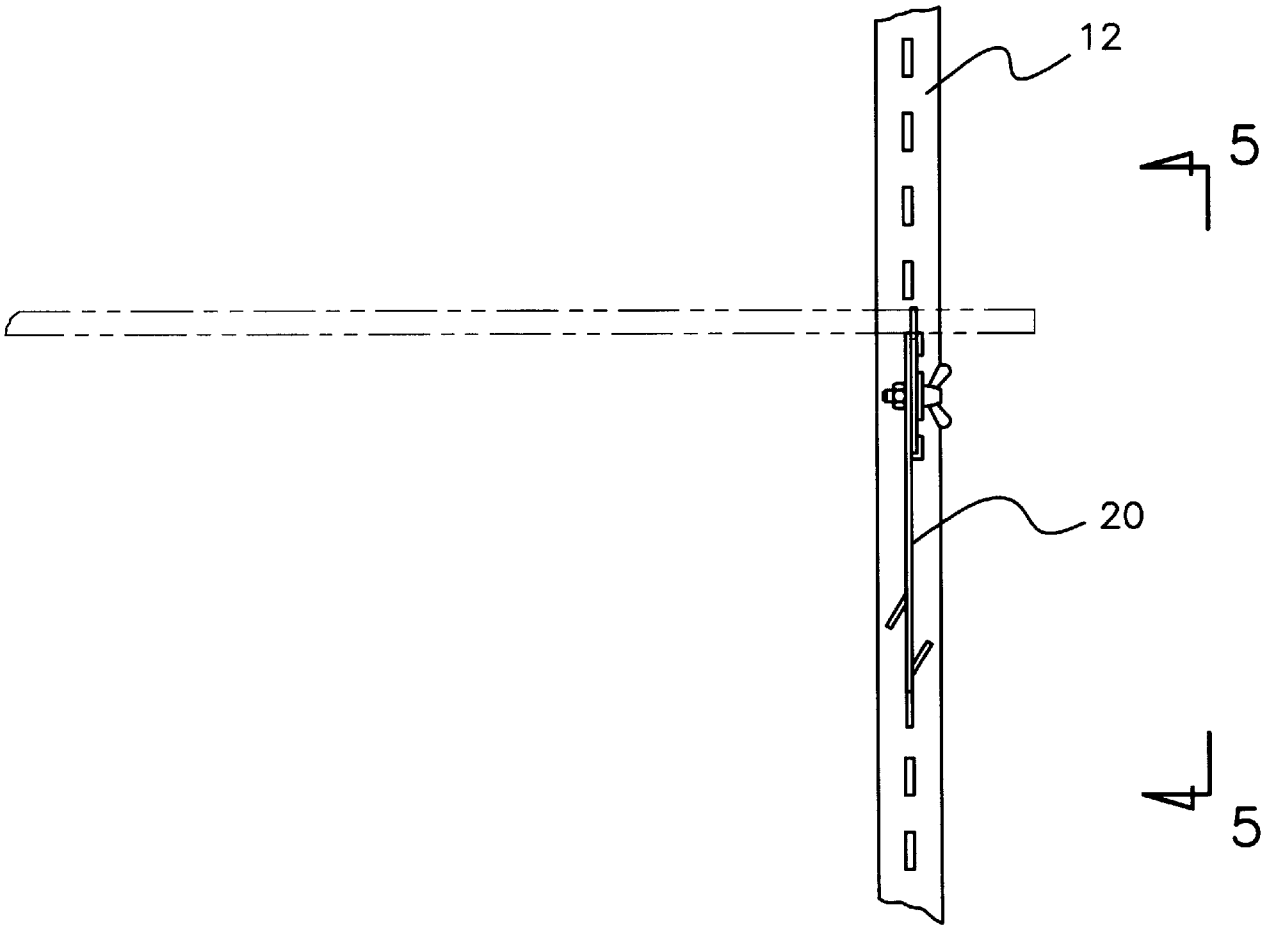
FIG. 4 is a schematic perspective view of another embodiment of the present invention showing a glass shelf being used.
Figure 5:
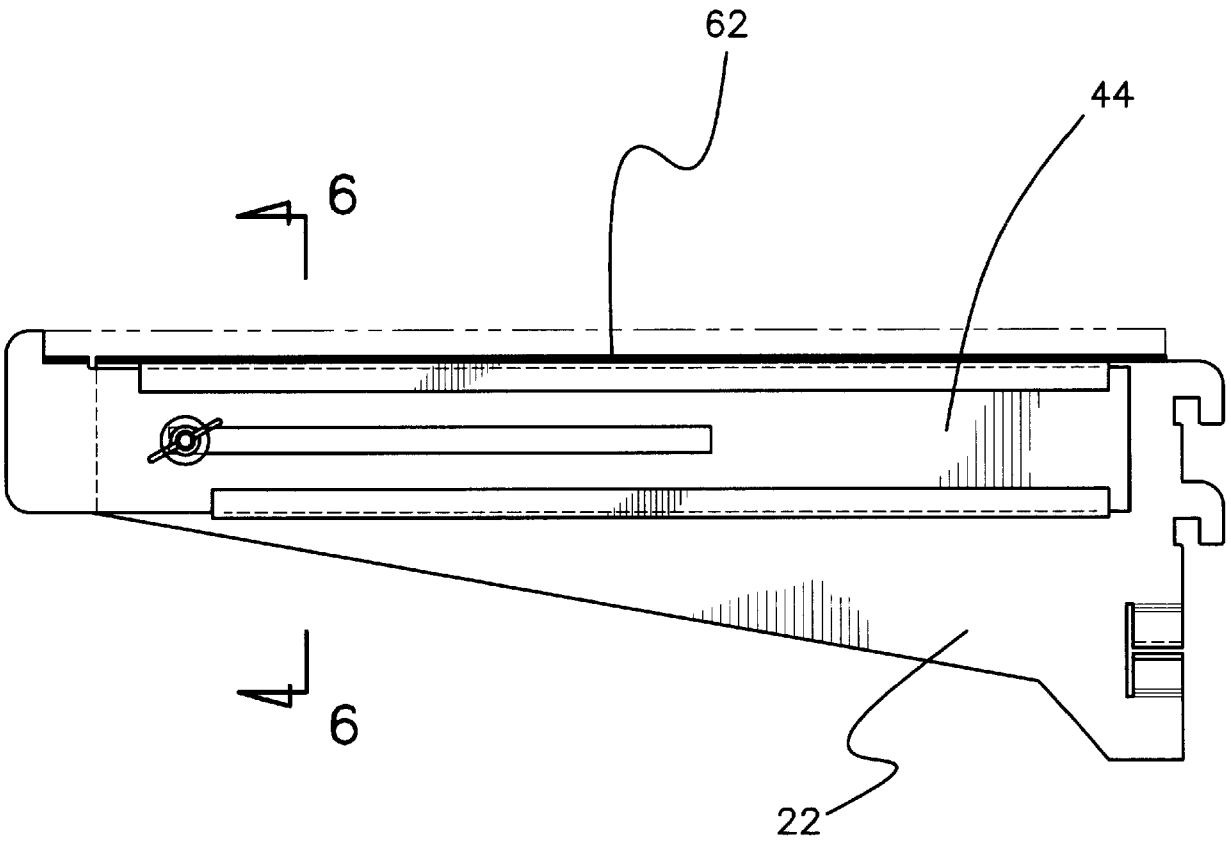
FIG. 5 is a schematic side view of the present invention showing an optional ridge being attached to a top edge of a stationary bracket.
Figure 6:
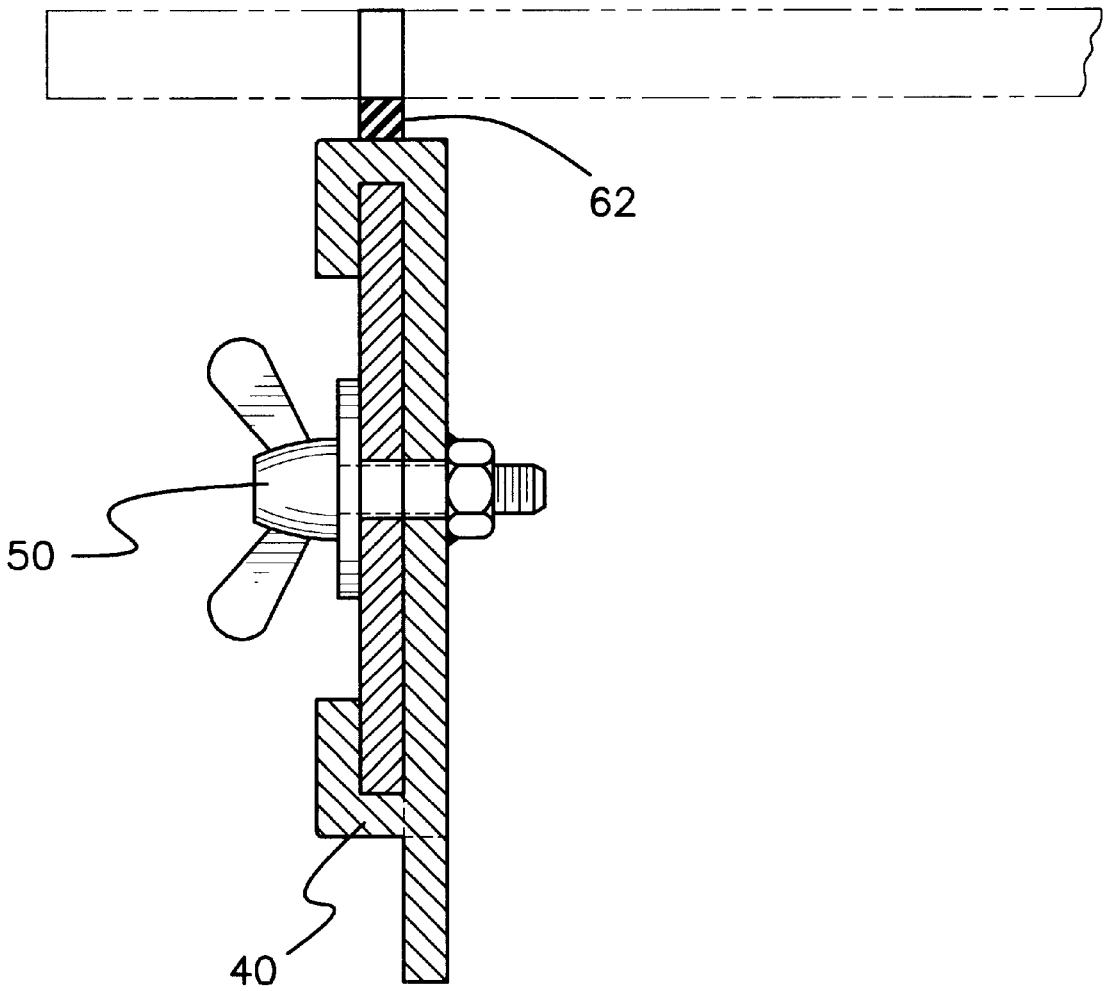
FIG. 6 is a schematic cross-sectional view of the present invention showing the ridge being positioned on a top edge of a stationary bracket.

With reference now to the drawings, and in particular to FIGS. 1 through 6 thereof, a new shelving assembly embodying the principles and concepts of the present invention and generally designated by the reference numeral 10 will be described.

As best illustrated in FIGS. 1 through 6, the shelving assembly 10 generally comprises a pair of mounting members 12 for mounting on a wall surface. Each of the mounting members 12 is elongated and includes a first end 13 and a second end 14. Each of the mounting members includes a plurality of slots 15 extending therethrough and spaced apart between the first and second ends 13 and 14 of the mounting members 12. Each of the mounting members 12 may comprise a substantially rigid material such as, for example, a metal (such as steel or aluminum) or a plastic.

A fastening means 17 for fastening each of the mounting members 12 to the wall is removably extended through each of the mounting members 12 and removably coupled to the wall. The fastening means 17 may comprise any type of fastener such as, for example, a screw or a nail.

A pair of extendable shelf supports 20 is removably couplable to the mounting members 12. Each of the shelf supports 20 comprises a stationary bracket 22 that may measure approximately eight inches in length. The bracket 22 includes a pair of lateral side surfaces 23 that may measure approximately two and a half inches to four inches in height. The bracket 22 also includes a perimeter edge 24. The perimeter edge 24 comprises a top edge 25, a bottom edge 26, a front edge 27 and a back edge 28. A distance between the top edge 25 and the bottom edge 26 of each of the brackets 22 tapers from the back edge 28 toward the front edge 27.

Each of the lateral side surfaces 23 includes a T-shaped slit 29 extending therein and extending through the back edge 28 of each of the brackets 22 such that a first tab 30 and a second tab 31 is defined. Each of the tabs 30 and 31 includes a free end 32. Each of the tabs 30 and 31 have an approximately 30 degree bend such that the free end 32 of the first tab 30 is orientated so as to point away from a first of the lateral side surfaces 23 in a first direction. The free end 32 of the second tab 31 is orientated so as to point away from a second of the lateral side surfaces 23 in a second direction. Each of the tabs 30 and 31 provide lateral support to the bracket 22. Each of the tabs 30 and 31 abut the wall surface preventing the bracket 22 from moving laterally in either the first or second direction. The T-shaped slit 29 may measure approximately one half inch in length.

The stationary bracket 22 has a pair of hook members 34 for securing the bracket 22 to one of the mounting members 12. Each of the hook members 34 includes a first portion 35 that is coupled to and extending away from the back edge 28 of each of the brackets 22. A second portion 36 of each of the hook members 34 is coupled to the first portion 35 thereof and is positioned generally perpendicular to the first portion 35. Each of the hook members 34 is removably insertable into one of the slots 15 of one of the mounting members 12.

The back edge 28 of the bracket 22 includes a pair of recesses 38 extending therein. Each of the recesses 38 is positioned generally adjacent to the first portion 35 of each of the hook members 34. Each of the recess 38 allows for easier insertion of each of the hook members 34 into one of the slots 15 of the mounting members 12 by increasing the space between the back edge 28 of the bracket 22 and the second portion 36 of the hook members 34. Although the pair of recess 38 allows for easier insertion of the brackets 22 into the mounting members 12, the present invention would be functional without the recesses.

Each of the brackets 22 includes a pair of rails 40 having a generally L-shape. Each of the rails 40 generally extends between the front and back edges 27 and 28 of the bracket 22. Each of the rails 40 includes a first portion 41 coupled to and extending away from a first of the lateral side surfaces 23. A second portion 42 of each of the rails 40 is coupled to and extending away from the first portion 41 of each of the rails 40. The second portion 42 of each of the rails 40 is orientated generally parallel to the bracket 22. A first of the rails 40 is positioned generally adjacent to the top edge 25 of the bracket 22. A second of the rails 40 is positioned generally between the first rail and the bottom edge 26 of the bracket 22.

A slidable member 44 is coupled to one of the lateral side surfaces 23 of the bracket 22 in a manner permitting sliding of the slidable member 44 with respect to the bracket member 22. The slidable member 44 is movably extended between each of the rails 40. The slidable member 44 includes a first end 45 and a second end 46. A pair of lateral sides 47 of the slidable member 44 includes an elongated slot 48 extending therethrough. The elongated slot 48 extends between the first and second ends 45 and 46 of the slidable member 44. The slidable member 44 may have a length of approximately seven inches with an elongated slot 48 measuring approximately four inches in length. However, the length of slidable member 44 and the elongated slot 48 may vary depending upon the length of the bracket 22.

A securing means 50 for securing the slidable member 44 in a selected position with respect to the bracket 22 is removably extended through the elongated slot 48 in the slidable member 44 and through a hole 52 in the bracket 22. In the preferred embodiment, the securing means 50 may comprise a wing nut, a bolt and a washer, wherein the washer is attached to the bracket 22.

A fastening means 54 is provided for fastening a shelf to the slidable member 44. The fastening means 54 comprises a plate 56 that has a first end 58 and a second end 59. The first end 58 of the plate 56 is coupled to the first end 45 of the slidable member 44. The second end 59 of the fastening means 54 is extendable to a front edge of a shelf. In the preferred embodiment, the fastening means 54 has a generally parallelogram-shape. However, the fastening means 54 may have a variety of shapes, such as, for example, an L-shape. The fastening may have a length of approximately three inches.

A mounting means 60 for mounting the fastening means 54 to a shelf is removably extended through the fastening means 45 and removably couplable to a front edge of a shelf. The mounting means 60 may comprise a screw.

In another embodiment, a ridge 62 is attached to the top edge 25 of the perimeter edge 24 of the stationary bracket 22 to prevent a glass shelf from moving or being scratched. The ridge 62 extends between the front and back edges 27 and 28 of the perimeter edge 24. The ridge 62 preferably comprises a resiliently flexible material such as, for example, a rubber or foam.

In use, the securing means 50 may be loosened and the slidable member 44 slid between said pair of rails 40 to an extended position. The slidable member 44 may be extended to accommodate a plurality of shelf sizes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shelving assembly for being removably coupled to a wall and supporting a shelf, said assembly comprising:

an extendable shelf support comprising;

a stationary bracket;

a slidable member being slidably mounted on said stationary bracket;

a securing means is provided for securing said slidable member in a selected position with respect to said stationary bracket; and a fastening means for fastening the shelf to said slidable member, said fastening means comprises a plate having a first end and a second end, said first end of said plate being coupled to a first end of said slidable member, a second end of said securing means being extendable to the shelf.

2. The shelving assembly of claim 1, additionally comprising a mounting member for mounting said extendable shelf support on a wall surface, wherein said mounting member is elongated and has a first end and a second end, said mounting member has a plurality of slots extending therethrough, each of said slots being spaced apart between said first and second ends of said mounting member, a fastening means for fastening said mounting member to the wall.

3. The shelving assembly of claim 1, wherein said stationary bracket has a pair of lateral side surfaces and a perimeter edge.

4. The shelving assembly of claim 1, wherein said bracket has a pair of hook members thereon for securing said stationary braclet to a mounting member having a plurality of slots extending therethrough, each of said slots being spaced apart between a first and second end of said mounting member, wherein each of said hook members is removably positioned in one of said slots.

5. The shelving assembly of claim 1, further comprising a pair of tails having a generally L-shape, said slidable member being inserted between said rails.

6. The shelving assembly of claim 5, wherein each of said rails generally extend between a front edge and a back edge of said stationary bracket, each of said rails has a first portion coupled to and extending away from a first lateral side surface of said stationary bracket, a second portion of each of said rails being coupled to and extending away from said first portion of each of said rails.

7. The shelving assembly of claim 1, wherein said slidable member has an elongated slot extending through a pair of lateral sides, said elongated slot extending between a first end and a second end of said slidable member, said securing means being removably extended through said elongated slot and through a hole in said stationary bracket member.

8. The shelving assembly of claim 1, further comprising a mounting means for mounting said fastening means to the shelf, said mounting means extending through said fastening means and being couplable to the shelf.

9. The shelving assembly of claim 1, further comprising a ridge being attached to a top edge portion of a perimeter edge of said stationary bracket, said ridge extending between front and back edge portions of said perimeter edge.

10. A shelving assembly for being removably coupled to a wall and supporting a shelf, said assembly comprising:

an extendable shelf support comprising;

a stationary bracket;

a slidable member being slidably mounted on said stationary bracket;

a securing means is provided for securing said slidable member in a selected position with respect to said stationary bracket;

wherein said stationary bracket has a pair of lateral side surfaces and a perimeter edge; and wherein the stationary bracket has a pair of tabs for stabilizing said stationary bracket against the wall surface, said pair of tabs being defined by a substantially T-shaped slit extending from a back edge of said bracket, said pair of tabs comprising a first tab and a second tab, each of said tabs has a free end, said free end of said first tab being orientated so as to extend away from a first of said lateral side surfaces in a first direction, said free end of said second tab being orientated so as to extend away from a second of said lateral side surfaces in a second direction.

11. The shelving assembly of claim 10, additionally comprising a mounting member for mounting said extendable shelf support on a wall surface, wherein said mounting member is elongated and has a first end and a second end, said mounting member has a plurality of slots extending therethrough, each of said slots being spaced apart between said first and second ends of said mounting member, a fastening means for fastening said mounting member to the wall.

12. The shelving assembly of claim 10, wherein said bracket has a pair of hook members thereon for securing said stationary bracket to a mounting member having a plurality of slots extending therethrough, each of said slots being spaced apart between a first end and second end of said mounting member, wherein each of said hook members is removably positioned in one of said slots.

13. The shelving assembly of claim 10, further comprising a pair of rails having a generally L-shape, said slidable member being inserted between said rails.

14. The shelving assembly of claim 13, wherein each of said rails generally extend between a front edge and a back edge of said stationary bracket, each of said rails has a first portion coupled to and extending away from a first lateral side surface of said stationary bracket, a second portion of each of said rails being coupled to and extending away from said first portion of each of said rails.

15. The shelving assembly of claim 10, wherein said slidable member has an elongated slot extending through a pair of lateral sides, said elongated slot extending between a first end and a second end of said slidable member, said securing means being removably extended through said elongated slot and through a hole in said stationary bracket member.

16. The shelving assembly of claim 10, further comprising a fastening means for fastening the shelf to said slidable member, said fastening means comprises a plate having a first end and a second end, said first end of said plate being coupled to a first end of said slidable member, a second end of said securing means being extendable to the shelf.

17. The shelving assembly of claim 16, further comprising a mounting means for mounting said fastening means to the shelf, said mounting means extending through said fastening means and being couplable to the shelf.

18. The shelving assembly of claim 10, further comprising a ridge being attached to a top edge portion of a perimeter edge of said stationary bracket, said ridge extending between front and back edge portions of said perimeter edge.

19. A kit for creating a shelving assembly, said assembly being removably coupled to a wall, said kit comprising:

a mounting member for mounting on a wall surface;

an extendable shelf support comprising;

a stationary bracket;

a slidable member being slidably mounted on said stationary bracket;

a securing means is provided for securing said slidable member in a selected position with respect to said stationary bracket;

a shelf board being removably mounted on said stationary bracket and said slidable member; and a pair of rails having a generally L-shape, said slidable member being inserted between said rails, said slidable member has an elongated slot extending through a pair of lateral sides of said slidable member, said elongated slot extending between a first and a second end of said slidable member, said securing means being removably extended through said elongated slot and through a hole in said stationary bracket member.

20. A kit for creating a shelving assembly, said assembly being removably coupled to a wall, said kit comprising:

a mounting member for mounting on a wall surface;

an extendable shelf support comprising;

a stationary bracket;

a slidable member being slidably mounted on said stationary bracket;

a securing means is provided for securing said slidable member in a selected position with respect to said stationary bracket;

a shelf board being removably mounted on said stationary bracket and said slidable member; and a fastening means for fastening said shelf to said slidable member, said fastening means comprises a plate having a first end and a second end, said first end of said plate being coupled to a first end of said slidable member, a second end of said securing means being extendable to a shelf, a mounting means for mounting said fastening means to said shelf, said mounting means extending through said fastening means and being couplable to said shelf.

* * * * *